US006135868A

United States Patent [19]

Brown et al.

[11] Patent Number: 6,135,868

[45] Date of Patent: Oct. 24, 2000

[54] GROOVE CLEANING DEVICE FOR CHEMICAL-MECHANICAL POLISHING

[75] Inventors: Brian J. Brown, Palo Alto; Robert Tolles, Santa Clara; James C. Nystrom, Palo Alto; Doyle Bennett, Santa Clara; Madhavi Chandrachood, Sunnyvale, all of Calif.

[73] Assignee: Applied Materials, Inc., Santa Clara, Calif.

[21] Appl. No.: 09/021,765

[22] Filed: Feb. 11, 1998

[51] Int. Cl.[7] ..... B24B 21/18

[52] U.S. Cl. ..... 451/443; 451/444

[58] Field of Search ..... 451/443, 444, 451/461, 56, 72

[56] References Cited

U.S. PATENT DOCUMENTS

| | | | |
|---|---|---|---|
| 5,216,843 | 6/1993 | Breivogel et al. | 51/131.1 |
| 5,456,627 | 10/1995 | Jackson et al. | 451/11 |
| 5,595,527 | 1/1997 | Appel et al. | 451/28 |
| 5,626,509 | 5/1997 | Hayashi | 451/285 |
| 5,643,067 | 7/1997 | Katsuoka et al. | 451/444 |
| 5,690,544 | 11/1997 | Sakurai . | |
| 5,775,983 | 7/1998 | Shendon et al. | 451/444 |
| 5,782,675 | 7/1998 | Southwick | 451/56 |
| 5,785,585 | 7/1998 | Manfredi et al. | 451/288 |
| 5,857,899 | 1/1999 | Volodarsky et al. . | |
| 5,902,173 | 5/1999 | Tanaka | 451/41 |
| 5,906,754 | 5/1999 | Appel et al. | 216/88 |
| 5,954,570 | 9/1999 | Yano et al. | 451/285 |

FOREIGN PATENT DOCUMENTS 0 787 561 A1 6/1997 European Pat. Off. .

*Primary Examiner*—Timothy V. Eley
*Assistant Examiner*—Dung Van Nguyen
*Attorney, Agent, or Firm*—Dugan & Dugan

[57] ABSTRACT

An improved chemical-mechanical polishing method and apparatus is provided. A brush is employed to continually brush slurry particles from surface features, e.g., grooves, on a polishing pad. In this manner slurry is prevented from becoming compacted within the grooves as the slurry passes beneath and is subjected to compressive forces of a wafer polishing head. The invention may be practiced by use of a stationary brush operatively coupled to the polishing pad surface, or by an improved conditioning assembly having both a diamond surface for conditioning the polishing pad and a brush for cleaning the pad's surface features. The brush portion of the conditioning assembly may or may not rotate as it is scanned across the surface of the polishing pad.

10 Claims, 3 Drawing Sheets

GROOVE CLEANING DEVICE FOR CHEMICAL-MECHANICAL POLISHING

The present invention relates to the field of semiconductor processing, and more particularly to a method and apparatus for polishing and/or planarizing semiconductor wafers and the thin films formed thereon.

BACKGROUND OF THE INVENTION

Modern semiconductor devices are typically multi-layered, having numerous metalization layers separated by numerous insulating oxides and interconnected with vias or contact holes. For instance, an interconnect for a typical multi-layer device is formed by depositing and patterning a first metal layer over the device, depositing an intermediate oxide over the patterned first metal layer, photolithographically defining a contact hole in the oxide, and depositing a second metal layer over the oxide that fills the contact hole and contacts the patterned first metal layer.

Patterning the first metal layer produces metal steps or undulations between where the first metal is removed and where the first metal remains. Because the intermediate oxide layer is a conformal layer, the oxide layer tracks these undulations. Accordingly, if the second metal layer were also deposited directly over the intermediate oxide layer, the undulations from the first metal layer would undesirably appear in the second metal layer.

Undulations in the second metal layer complicate patterning of the second metal layer, especially in high resolution, fine line-width applications, because no single focal plane exists on the second metal layer. A non-planar second metal layer, therefore, undesirably increases the line-widths produceable in the second metal layer. Furthermore, if the second metal layer undulations are large (e.g., on the order of the thickness of the second metal layer), voids or open circuits may form in the second metal layer. These problems may propagate to subsequently deposited material layers.

To prevent step or undulation propagation, the intermediate oxide layer is preferably planarized, removing any steps or undulations formed therein, prior to deposition of the second metal layer. Planarization is typically performed mechanically by forcing the semiconductor wafer face down against a semi-porous polishing pad which is saturated with an abrasive compound (i.e., a slurry) and by rotating the polishing pad relative to the wafer. The rotary motion between the polishing pad and the wafer mechanically removes layers of the intermediate oxide and is continued until the oxide steps or undulations are removed. This process is generally referred to as a chemical mechanical polishing (CMP).

To facilitate material removal during the CMP process the polishing pad is provided with grooves that channel slurry to the polishing pad/wafer interface, and that provide a path for wafer material to be removed from the polished wafer surface. During polishing, however, the downward force of the wafer against the polishing pad compacts slurry particles within these grooves, reducing the supply of fresh slurry to the polishing pad/wafer interface, the removal rate of wafer material, and the overall polishing efficiency and throughput of the CMP process, as well as giving rise to defects in the form of wafer scratches as described below. Additionally, the downward force of the wafer against the polishing pad causes the semi-porous surface of the polishing pad to pack down, causing polishing rates to become low and unpredictable, and necessitating frequent polishing pad replacement.

To extend the useful life of a polishing pad, a pad conditioner that roughens or "conditions" the polishing pad surface is employed insitu, while the polishing pad polishes a wafer; or ex-situ, after wafer polishing is complete. A typical pad conditioner comprises a diamond surface that continually roughens the polishing pad surface by scribing additional "microgrooves" in the polishing pad surface. Continuous roughening of the polishing pad surface ensures adequate abrasion (e.g., due to slurry saturation of the roughened surface) at the polishing pad/wafer interface. (See, for example, U.S. Pat. No. 5,216,843 to Breivogel et al.).

While pad conditioners significantly increase a polishing pad's abrasive lifetime, they do not address the problem of slurry debris (e.g., compacted, dried slurry) within the slurry grooves. In fact, during the polishing/conditioning process, the compacted slurry material which fills the pad's original grooves maybe freed in large chunks that can scratch and produce defects in the polished wafer. Thus the polishing process itself can become a defect source.

Accordingly a need exists for a CMP apparatus and method that both extends the useful life of a polishing pad and eliminates wafer scratches caused by compacted slurry material.

SUMMARY OF THE INVENTION

The present invention addresses the shortcomings of the prior art by providing a chemical mechanical polishing (CMP) device that employs a brush for continually cleaning slurry particles from grooves (i.e., surface features in which slurry debris may collect), such as machined grooves, perforations or naturally occurring features. It will be understood that the pads described and claimed herein are hard pads such as those that are formed by casting (e.g., cast polyurethane), and that grooved pads refer to hard pads having surface features in which slurry debris may collect. The brush preferably comprises nylon bristles or other wear resistant material that is chemically stable in a corrosive CMP environment. The brush may be coupled in a stationary manner, or may rotate or roll, etc., as it impacts the polishing pad surface.

In a preferred embodiment the brush is coupled to a pad conditioner, such as a diamond embedded disk, and is scanned with the pad conditioner across the polishing pad surface. The brush may rotate with the pad conditioner if desired, or may be mounted to an anti-rotation device so as to remain stationary while the pad conditioner rotates. When coupled to the pad conditioner device, the brush is preferably spring loaded so that when the brush is not in contact with the polishing pad, a polishing pad contacting surface of the brush projects beyond a polishing pad contacting surface of the pad conditioner. Thus, as the brush bristles wear they maintain sufficient contact with the bottom of each slurry groove to brush slurry particles therefrom.

Accordingly because the present invention continuously removes particles from the polishing pad grooves, no slurry debris builds up therein, and the present invention virtually eliminates defects caused by chunks of slurry debris such as particles that compact within, and subsequently dislodge from polishing pad slurry grooves scratching the wafer surfaces. A higher quality polished film results, scrapped wafer costs are reduced and thus the overall cost per wafer unit processed is reduced.

Other objects, features and advantages of the present invention will become more fully apparent from the a following detailed description of the preferred embodiments, the appended claims and the accompanying drawings.

DETAILED DESCRIPTION OF THE PREFERRED EMBODIMENTS

Figure 1:
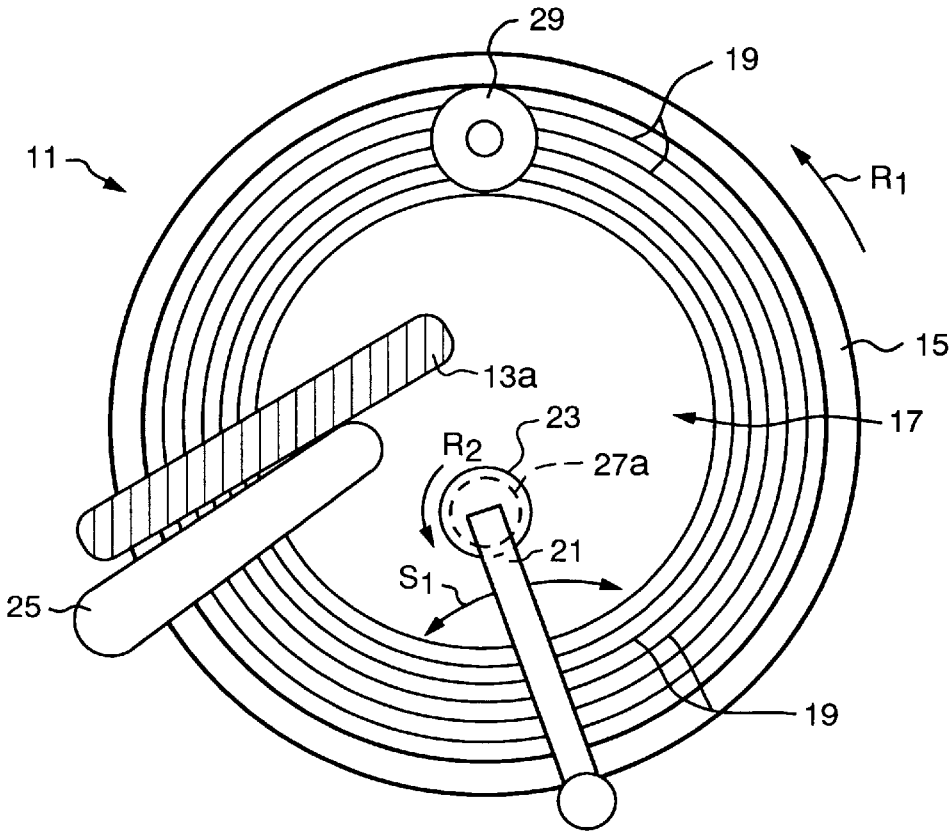
FIG. 1 is a schematic top plan view of an inventive chemical mechanical polishing device which employs a brush for reducing slurry related defects.

FIG. 1 is a schematic top plan view of an inventive chemical mechanical polishing device 11 which employs a brush 13*a* for reducing slurry related defects as further described below. The polishing device 11 comprises a rotatable platen 15 on which a grooved polishing pad 17 for polishing semiconductor wafers is mounted. The polishing pad 17 has at least one groove 19 and typically has a plurality of concentric circumferential grooves 19 which are disposed along the outer portion of the polishing pad 17.

The polishing device 11 further comprises a pivot arm 21, a holder or conditioning head 23 mounted to one end of the pivot arm 21, a slurry source such as a slurry/rinse arm 25, a pad conditioner 27*a*, such as a pad embedded with diamond crystals, mounted to the underside of the conditioning head 23, and a wafer mounting head 29 operatively coupled to the platen 15 so as to press a wafer (not shown) against the grooves 19 of the polishing pad 17.

In the preferred embodiment of FIG. 1, the brush 13*a* is mounted to the slurry/rinse arm 25 so as to stationarily contact the surface of the polishing pad 17. The pivot arm 21 is operatively coupled to the platen 15, and holds the conditioning head 23 against the polishing pad 17, as further described below.

In operation, a wafer (not shown) is placed face down beneath the wafer mounting head 29, and the wafer mounting head 29 presses the wafer firmly against the grooved portion of the polishing pad 17. Slurry is introduced to the polishing pad 17 via the slurry/rinse arm 25, and the platen 15 rotates as indicated by the arrow $R_1$. The pivot arm 21 scans from side to side in an arcing motion as indicated by the arrow $S_1$ and the conditioning head 23 rotates as indicated by the arrow $R_2$.

The grooves 19 channel the slurry (not shown) between the wafer and the polishing pad 17. The semi-porous surface of the polishing pad 17 becomes saturated with slurry which, with the downward force of the wafer mounting head 29 and the rotation of the platen 15, abrades and planarizes the surface of the wafer. The diamond crystals (not shown) embedded in the rotating conditioner 27*a* continually roughen the surface of the polishing pad 17 to ensure consistent polishing rates.

As the slurry filled grooves travel beneath the wafer mounting head 29, the downward force of the wafer mounting head 29 and the wafer thereunder, in addition to other factors such as the pH, the temperature, and the act of polishing itself, tend to compact and/or dry the slurry particles within the grooves 19, forming hard chunks which may dislodge and scratch the wafer as previously described. However, unlike conventional polishing devices, the inventive polishing device 11 employs the brush 13*a* which continually sweeps slurry particles from the grooves 19, reducing the probability that slurry particles will remain in the grooves 19 long enough to form larger masses capable of dislodging and scratching the wafer being polished, as further described below with reference to FIG. 2.

Figure 2:
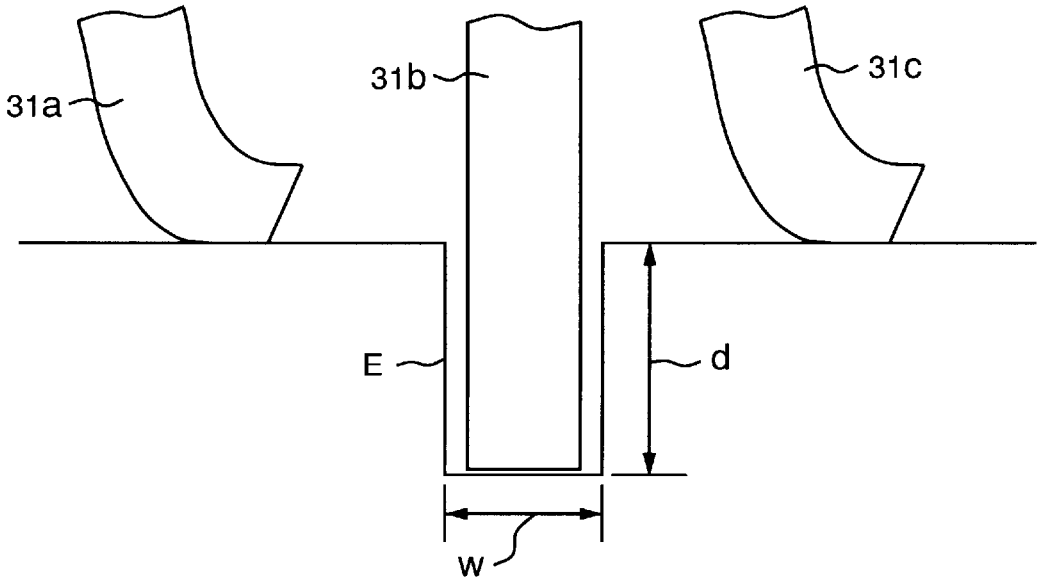
FIG. 2 is a schematic side view of the bristles of the brush of FIG. 1 during wafer polishing.

FIG. 2 is a schematic side view of the bristles 31, specifically bristles 31*a–c*, of the brush 13*a* (FIG. 1) as the bristles 31 pass over a groove 19. The configuration of the bristles 31 depends upon the dimensions of groove 19; i.e., the bristles 31 are longer than the depth d of the groove 19, and are narrower than the width w of the groove 19, so that the bristles 31 easily reach the bottom of the groove 19 as shown in FIG. 2 by bristle 31*b*.

The bristles 31 are preferably made of a wear resistant material that is chemically stable in a corrosive environment, such as nylon, polypropylene, etc., and that is sufficiently stiff so as to transfer momentum to a slurry particle (not shown) positioned within the groove 19. For example, as a bristle 31 passes through the groove 19, it straightens from the position shown by bristle 31*c*, to the position shown by bristle 31*b*, ejecting any slurry particles within the groove 19 from the groove 19, and then re-bends as the bristle strikes the front edge E of the groove 19.

Although the brush 13*a* remains stationary, the platen 15 rotates therebeneath, causing the grooves 19 to move in an arcing path relative to the brush 13*a*. The arcing path of the grooves 19 causes a plurality of the bristles 31 to move through the grooves 19. In this manner the brush 13*a* prevents slurry particles from building up within the grooves 19 and from being compressed by the repeated downward force applied to the slurry particle as the grooves 19 pass under the wafer mounting head 29. As a result fewer compacted slurry chunks form and fewer defects arise during polishing. Even greater slurry clearing is achieved with the embodiments of FIGS. 3 and 4 which couple a brush to the conditioner 27, as described below.

Figure 3:
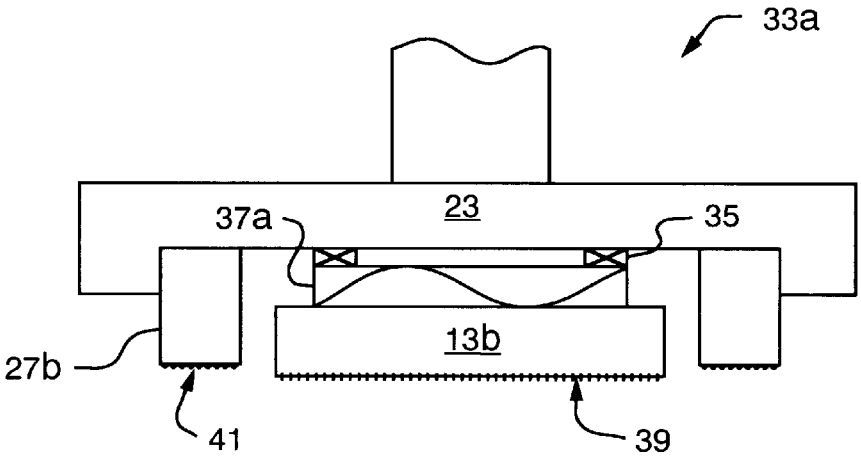
FIG. 3 is a side sectional view of a first embodiment of an inventive conditioning assembly, which may replace the separate brush and conditioning head of FIG. 1.

FIG. 3 is a side sectional view of a first embodiment of an inventive conditioning assembly 33*a*, which may replace the separate brush 13*a* and conditioning head 23 of FIG. 1. The conditioning assembly 33*a* comprises the holder or conditioning head 23, a conditioner 27*b* which assumes a ring shape and which is coupled to the conditioning head 23, and a brush 13*b* which is preferably disk shaped and positioned within the ring shaped conditioner 27*b*.

Like the conditioner 27*b*, the brush 13*b* is coupled to the conditioning head 23, and may be coupled so as to rotate with the conditioning head 23 and the conditioner 27*b*, or may be stationarily coupled to the conditioning head 23 via an anti-rotation element 35, as shown in FIG. 3. The anti-rotation element 35 may comprise one or more bearings or other similar mechanisms as will be readily apparent to those of ordinary skill in the art.

The brush 13*b* is coupled to the anti-rotation element 35 via a spring loaded mechanism 37*a*, e.g., one or more springs, which causes a pad contacting surface 39 of the brush 13*b* to project beyond a pad contacting surface 41 of the conditioner 27*b* when no outside force is applied to the brush 13*b* (i.e., when the spring loaded brush 13*b* is in an unenergized state). Thus, as the pad contacting surface 39 of the brush 13*b* wears, the spring loaded mechanism 37*a* continues to force the pad contacting surface 39 of the brush 13*b* against the polishing pad 17, maintaining sufficient contact between the bristles 31 and the bottom of the grooves 19 for proper slurry removal. Because the brush 13*b* scans across the polishing pad 17 with the conditioner 27*b*, the bristles 31 of the brush 13*b* have increased momentum relative to the grooves 19, facilitating slurry removal from the grooves 19 as described previously with reference to FIG. 2. To further increase momentum between the brush and the grooves, the anti-rotation element 35 may be omitted.

Figure 4:
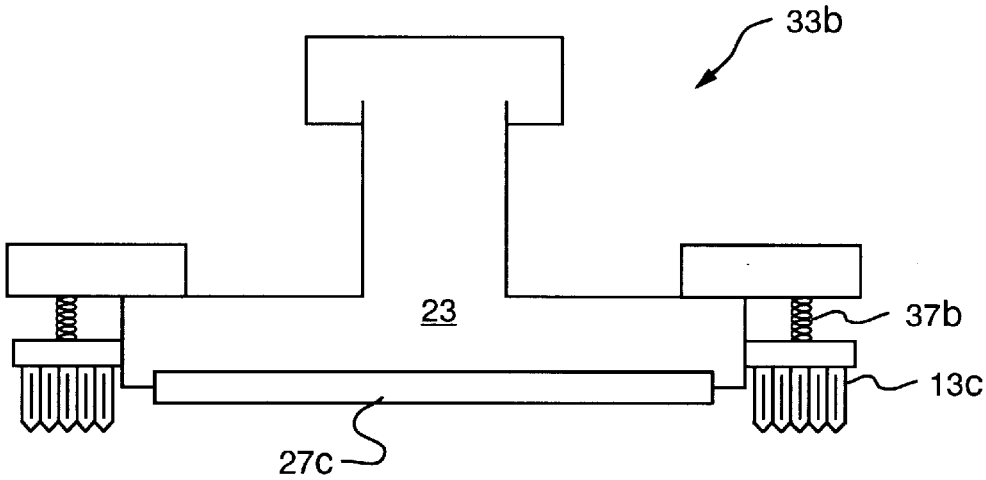
FIG. 4 is a side sectional view of a second embodiment of an inventive conditioning assembly, which may replace the separate brush and conditioning head of FIG. 1.

FIG. 4 is a side sectional view of a second embodiment of an inventive conditioning assembly 33*b*, which may replace the separate brush 13*a* and conditioning head 23 of FIG. 1. The conditioning assembly 33*b* comprises the conditioning head 23, a brush 13*c* which assumes a ring shape and which is coupled to the conditioning head 23 via a spring loaded mechanism 37*b*, and a conditioner 27*c* which is preferably disk shaped and positioned within the ring shaped brush 13*c*. Because, as shown in FIG. 4, the brush 13*c* is coupled directly to the conditioning head 23, the brush 13*c*, the conditioner 27*c*, and the conditioning head 23 rotate as a unit. In this manner the bristles 31 of the brush 13*c* have considerably increased momentum relative to the grooves 19, facilitating slurry removal from the grooves 19 as described previously with reference to FIG. 2. Alternatively the brush 13*c* may be coupled to the conditioning head 23 via an anti-rotation element such as the anti-rotation element 35 of FIG. 3.

Figure 5A:
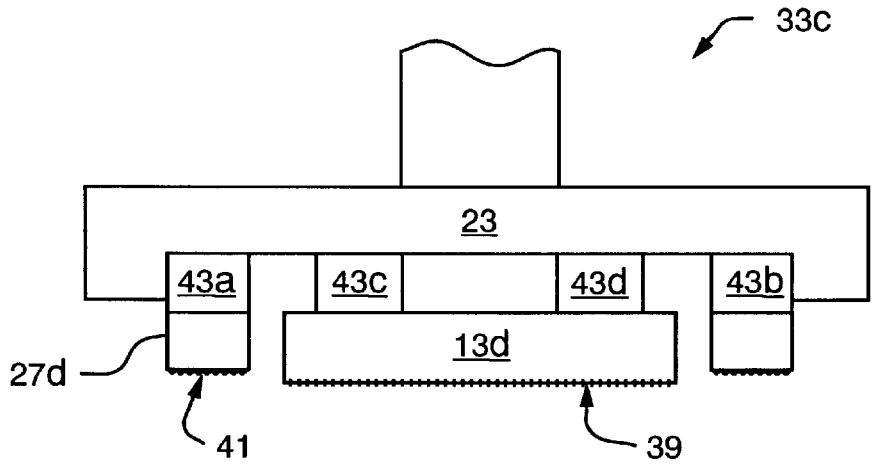
FIGS. 5A and 5B are a side sectional view and a bottom plan view, respectively, of a third embodiment of an inventive conditioning assembly, which may replace the separate brush and conditioning head of FIG. 1.
Figure 5B:
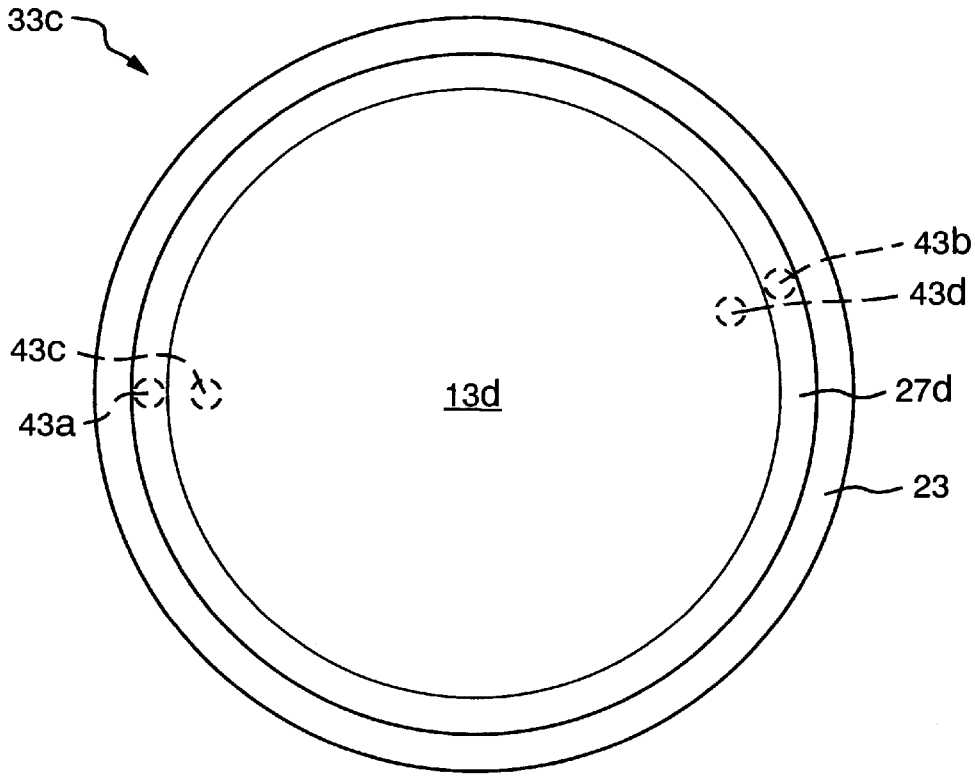

FIGS. 5A and 5B are a side sectional view and a bottom plan view, respectively, of a third embodiment of an inventive conditioning assembly 33*c*, which may replace the separate brush 13*a* and conditioning head 23 of FIG. 1. As shown in FIGS. 5A and 5B, the conditioning assembly 33*c* comprises the holder or conditioning head 23, a conditioner 27*d* which assumes a ring shape and which is coupled to the conditioning head 23 via a position controller, such as pneumatic pistons 43*a*, 43*b*; and a brush 13*d* which is preferably disk shaped and positioned within the ring shaped conditioner 27*d*.

Like the conditioner 27*d*, the brush 13*d* is coupled to the conditioning head 23 via a position controller, such as pneumatic pistons 43*c*, 43*d*, and may be coupled so as to rotate with the conditioning head 23 and the conditioner 27*d*, or may be stationarily coupled to the conditioning head 23 via an anti-rotation element (not shown) such as that described with reference to FIGS. 3 and 4.

The position controllers (e.g., pneumatic pistons 43*a–d*) allow the distance of both the conditioner 27*d* and the brush 13*d* above the polishing pad to be independently controlled. Thus, the position controllers not only can adjust to accommodate bristle wear, but also allow selective use of the conditioner 27*d* and/or the brush 13*d*. For example, only the conditioner 27*d* may be used during wafer polishing and both the brush 13*d* and the conditioner 27*d* may be used subsequently when the polishing pad 17 is cleaned using a high pressure spray of de-ionized water. Such selective use is advantageous in many applications, for instance, when worn bristle particles may damage the wafer being polished.

The present invention prevents large compacted slurry particles from forming within the grooves of a polishing pad, and prevents wafer scratches and defects that would otherwise occur as chunks of compacted slurry dislodge from the grooves and are forced across the wafer surface during polishing. Furthermore, because the slurry grooves are continuously cleared, slurry is more effectively channeled through the slurry grooves resulting in more efficient polishing rates.

The foregoing description discloses only the preferred embodiments of the invention, modifications of the above disclosed apparatus and method which fall within the scope of the invention will be readily apparent to those of ordinary skill in the art. For instance, while nylon or polypropylene bristles are presently preferred, other wear resistant and corrosive resistant bristle materials may be employed. Additional momentum may be provided to the bristles by mounting the bristles on a rotating, roller-type brush if so desired. Also, bristle free pliable rollers can be similarly used during polishing to wipe slurry from polishing pad grooves.

The present invention may be used with any polishing pad conditioners, including but not limited to those that have diamonds embedded in a metal (e.g., nickel) or polymer matrix, and those that have individual diamond crystals "embedded" in a screw-type holder. It will be understood that as used herein the term "diamond" includes any material abrasive enough to resurface a hard polishing pad, such as a cast polishing pad, without depositing debris on the polishing pad surface.

Finally, although the conditioning assemblies disclosed herein comprise concentric brushes and conditioners that may rotate together, the inventive conditioning assembly may comprise brushes and conditioners that are coupled adjacent each other, that are non-circular and/or that rotate in opposite directions.

Accordingly, while the present invention has been disclosed in connection with the preferred embodiments thereof, it should be understood that other embodiments may fall within the spirit and scope of the invention, as defined by the following claims.

The invention claimed is:

1. A conditioning assembly for conditioning a pad for polishing semiconductor wafers comprising:

a conditioner comprising:

a surface comprising a disk having one or more diamond crystals embedded therein, for roughening the pad surface;

a brush which surrounds the diamond embedded disk, the brush having a plurality of bristles for deterring slurry from compacting in surface features of the pad;

wherein the bristles are sized so as to easily fit within the surface features of the pad, and are sufficiently stiff so as to remove slurry particles from the surface features;

a holder; and a spring loaded mechanism, operatively coupled to the holder, and further wherein the conditioner is operatively coupled to the holder, and the brush is operatively coupled to the spring loaded mechanism, such that the spring loading mechanism causes a pad contacting surface of the brush to project beyond a pad contacting surface of the conditioner when in an unenergized stated.

2. The conditioning assembly of claim 1 further comprising an arm, wherein the holder is rotatably coupled to the arm so that the brush and the conditioner coupled to the holder may rotate.

3. The conditioning assembly of claim 2 further comprising an anti-rotational element coupled between the holder and the spring loaded mechanism such that the conditioner can rotate independently from the brush.

4. The conditioning assembly of claim 3 wherein the anti-rotation element comprises a bearing.

5. A conditioning assembly for conditioning a pad for polishing semiconductor wafers comprising:

a conditioner comprising:

a surface comprising a disk having one or more diamond crystals embedded therein, for roughening the pad surface; and a brush which surrounds the diamond embedded disk, the brush having a plurality of bristles for deterring slurry from compacting in surface features of the pad;

wherein the bristles are sized so as to easily fit within the surface features of the pad, and are sufficiently stiff so as to remove slurry particles from the surface features.

6. The conditioning assembly of claim 5 wherein the conditioner surrounds the outer perimeter of the brush.

7. The conditioning assembly of claim 5 further comprising an arm, wherein the holder is rotatably coupled to the arm so that the brush and the conditioner coupled to the holder may rotate.

8. The conditioning assembly of claim 7 further comprising an anti-rotation element coupled between the holder and the spring loaded mechanism such that the conditioner can rotate independently from the brush.

9. The conditioning assembly of claim 8 wherein the anti-rotation element comprises a bearing.

10. A polishing device for polishing semiconductor wafers, comprising:

a rotatable platen;

the conditioner of claim 6 operatively coupled to the pivot arm;

a grooved polishing pad mounted on the rotatable platen;

a slurry source operatively coupled to the platen to provide slurry to the polishing pad; and a pivot arm operatively coupled to the platen and to the conditioner for scanning the conditioner across the polishing pad.

* * * * *